US010435959B2

(12) United States Patent
Pendleton et al.

(10) Patent No.: US 10,435,959 B2
(45) Date of Patent: Oct. 8, 2019

(54) ONE TRIP TREATING TOOL FOR A RESOURCE EXPLORATION SYSTEM AND METHOD OF TREATING A FORMATION

(71) Applicants: Bryan P. Pendleton, Cypress, TX (US); Joseph Sheehan, Cypress, TX (US); Deshuttaney Mosley, Houston, TX (US); Shannon Martin, Houston, TX (US); John Vu, Houston, TX (US); Matthew J. Krueger, Houston, TX (US); Mark J. Knebel, Tomball, TX (US)

(72) Inventors: Bryan P. Pendleton, Cypress, TX (US); Joseph Sheehan, Cypress, TX (US); Deshuttaney Mosley, Houston, TX (US); Shannon Martin, Houston, TX (US); John Vu, Houston, TX (US); Matthew J. Krueger, Houston, TX (US); Mark J. Knebel, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 230 days.

(21) Appl. No.: 15/413,592

(22) Filed: Jan. 24, 2017

(65) Prior Publication Data

US 2018/0209224 A1 Jul. 26, 2018

(51) Int. Cl.
*E21B 41/00* (2006.01)
*E21B 17/07* (2006.01)
(Continued)

(52) U.S. Cl.
CPC ..... *E21B 17/07* (2013.01); *E21B 23/002* (2013.01); *E21B 33/12* (2013.01); *E21B 41/0035* (2013.01)

(58) Field of Classification Search
CPC combination set(s) only.
See application file for complete search history.

(56) References Cited

U.S. PATENT DOCUMENTS 3,109,490 A * 11/1963 Baker ..... E21B 33/12 166/114
4,540,051 A 9/1985 Schmuck et al.
(Continued)

FOREIGN PATENT DOCUMENTS

WO 2011159890 A2 12/2011

OTHER PUBLICATIONS

International Search Report and the Written Opinion of the International Searching Authority; PCT/US2017/066114; dated Mar. 29, 2018; 14 pages.

*Primary Examiner* — Taras P Bemko
*Assistant Examiner* — Ronald R Runyan
(74) *Attorney, Agent, or Firm* — Cantor Colburn LLP

(57) ABSTRACT

A method of treating a first bore and at least one second bore connected to the first bore in one downhole trip includes guiding a treating tool including a seal assembly defining and a shroud extending about the seal assembly downhole, guiding the seal assembly and the shroud along a diverter positioned near an intersection of the first bore and the at least one second bore into the at least one second bore, shifting the shroud relative to the seal assembly exposing the seal assembly in the at least one second bore, performing a first treatment in the at least one second bore, positioning the seal assembly and the shroud uphole of the diverter, passing the seal assembly through an opening in the diverter having a diverter opening, and performing a second treatment in the first bore.

18 Claims, 5 Drawing Sheets

(51) Int. Cl.
*E21B 33/12* (2006.01)
*E21B 23/12* (2006.01)

(56) References Cited

U.S. PATENT DOCUMENTS

| | | | | |
|---|---|---|---|---|
| 7,128,146 | B2 | 10/2006 | Baugh et al. | |
| 8,256,517 | B2 | 9/2012 | Ingraham et al. | |
| 8,985,203 | B2 | 3/2015 | Stokes et al. | |
| 2005/0126787 | A1 | 6/2005 | Gomez | |
| 2010/0163240 | A1* | 7/2010 | Ingraham | E21B 41/0035 166/313 |
| 2011/0114320 | A1 | 5/2011 | Sponchia et al. | |
| 2012/0055671 | A1* | 3/2012 | Stromquist | E21B 23/006 166/298 |
| 2015/0218899 | A1 | 8/2015 | Stokes | |

* cited by examiner

ONE TRIP TREATING TOOL FOR A RESOURCE EXPLORATION SYSTEM AND METHOD OF TREATING A FORMATION

BACKGROUND

A variety of borehole treatments involve pumping a fluid, under pressure into a wellbore. One such treatment is fracturing where balls of increasing diameter are sequentially dropped on seats provided in the wellbore. The seats define, at least in part, treatment zones. After each ball is mated to a corresponding seat, fluid pressure is applied to initiate, for example, a fracturing operation in a particular zone. After each zone has been treated, the balls and ball seats may be removed through a variety of methods including milling and dissolution.

In multilateral applications, one or more lateral bores extend from a main bore. Each lateral bore and the main bore may define a treatment zone. Currently, treating each zone required a separate operation. More specifically, a diverting tool was placed downhole of each lateral bore. The diverting tool is sized so as to guide a treating string arranged in a first configuration into an associated lateral bore. Following treatment, the treating string is withdrawn. The treating tool is then reconfigured to pass through the diverter. The process is restarted the main bore. Treating lateral bores and the main bore in this manner is a time consuming and costly process.

SUMMARY

A method of treating a first bore and at least one second bore connected to the first bore in one downhole trip of a treating tool includes guiding the treating tool including a seal assembly defining a first diameter and a shroud extending about the seal assembly defining a second diameter downhole, guiding the seal assembly and the shroud along a diverter positioned near an intersection of the first bore and the at least one second bore into the at least one second bore having a third diameter greater than the second diameter, shifting the shroud relative to the seal assembly exposing the seal assembly in the at least one second bore, performing a first treatment in the at least one second bore, positioning the seal assembly and the shroud uphole of the diverter, passing the seal assembly through an opening in the diverter having a diverter opening including a fourth diameter greater than the first diameter and smaller than the second diameter, and performing a second treatment in the first bore.

A one trip treating tool includes a tubular defining a seal assembly having an inner surface defining a passage, an outer surface and a terminal end portion, and a shroud arranged about the outer surface adjacent the terminal end portion of the seal assembly. The shroud is sized to pass into a first bore of a well bore. The first bore has a first diameter. The seal assembly is sized to pass into a second bore of the wellbore. The second bore has a second diameter that is less than the first diameter. The one trip treating tool is operable to perform a treatment of each of the first and second bores in one downhole trip.

BRIEF DESCRIPTION OF THE DRAWINGS

Referring now to the drawings wherein like elements are numbered alike in the several Figures.

DETAILED DESCRIPTION

Figure 1:
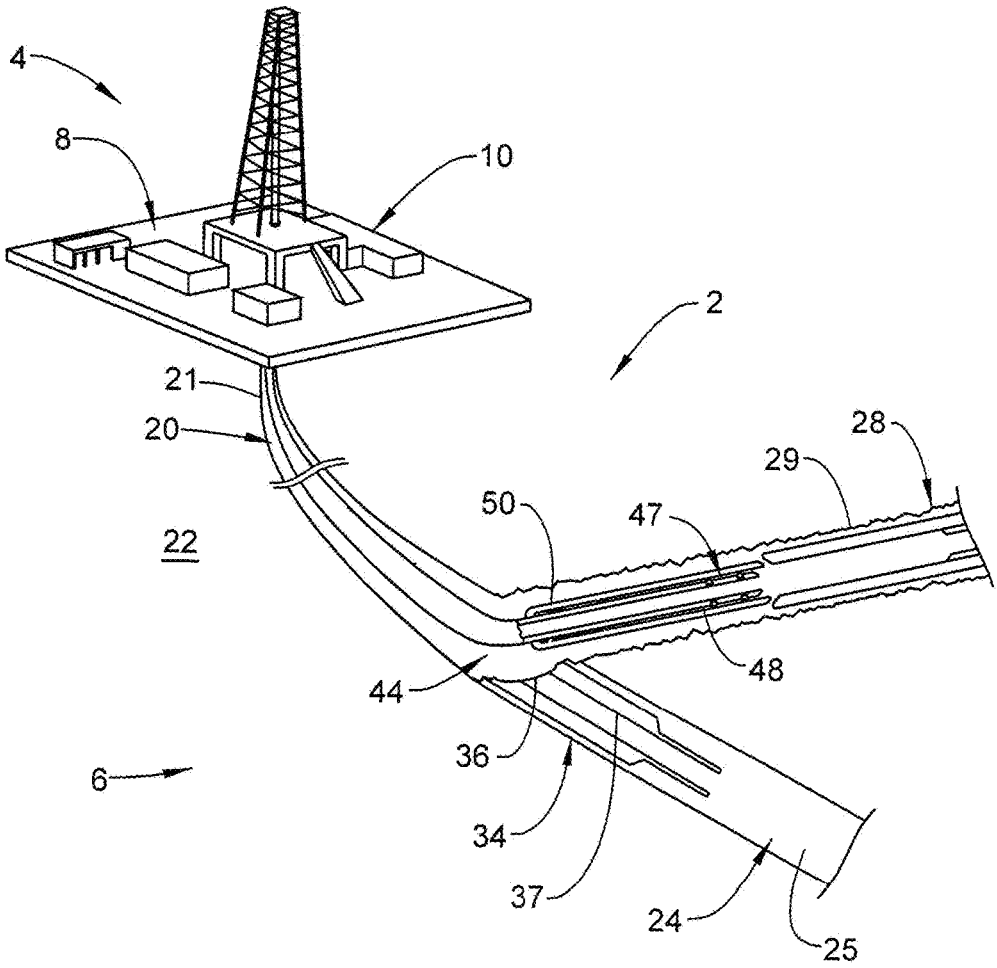
FIG. 1 depicts a resource exploration system including a one trip treating tool, in accordance with an aspect of an exemplary embodiment.

A resource exploration system, in accordance with an exemplary embodiment, is indicated generally at 2, in FIG. 1. Resource exploration system 2 should be understood to include well drilling operations, resource extraction and recovery, $CO_2$ sequestration, and the like. Resource exploration system 2 may include a surface system 4 operatively connected to a downhole system 6. Surface system 4 may include pumps 8 that may aid in treatment, completion and/or extraction processes, as well as fluid storage 10. Fluid storage 10 may contain a gravel pack fluid or slurry (not shown) or a fracturing fluid (also not shown) that may be introduced into downhole system 6.

Figure 2:
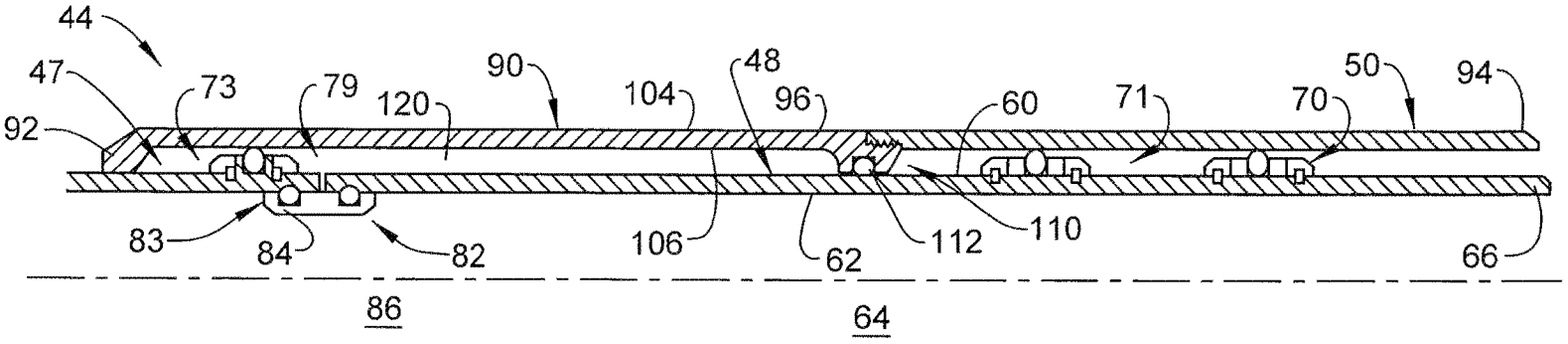
FIG. 2 depicts a partial cross-sectional side view of the one trip treating tool in a run-in configuration, in accordance with an aspect of an exemplary embodiment.
Figure 3:
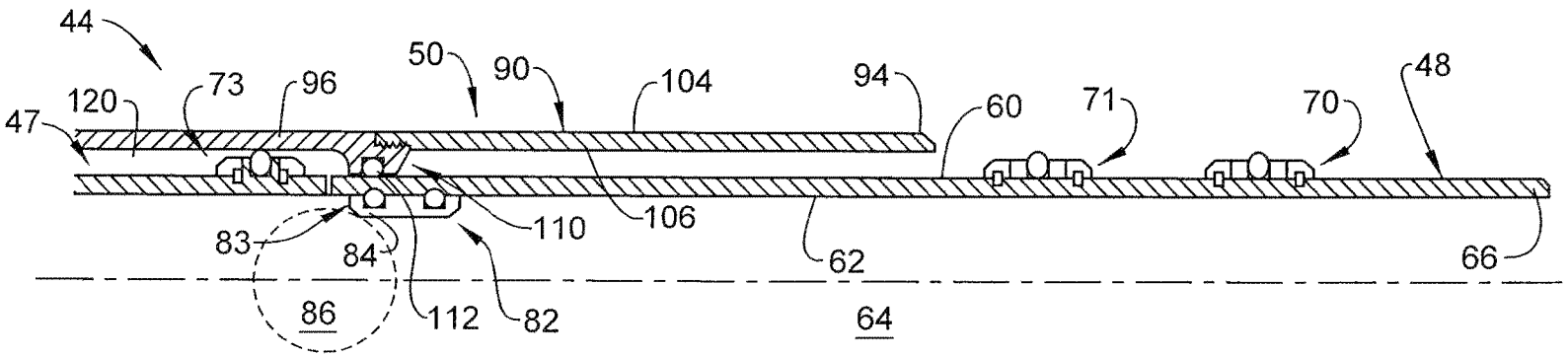
FIG. 3 depicts a partial cross-sectional side view of the one trip treating tool of FIG. 2 in a deployed configuration.

Downhole system 6 may include a system of tubulars 20 that is extended into a wellbore 21 formed in formation 22. Wellbore 21 includes a first bore 24, which may take the form of a main bore 25, and at least one second bore 28, which may take the form of a lateral bore 29. Second bore 28 includes a first diameter (not separately labeled). A diverter 34 is arranged in first bore 24 downhole of second bore 28. Diverter 34 includes an opening 36 that defines a passage 37 having a second diameter (also not separately labeled) that is smaller than the first diameter. A one trip treating tool 44 may be employed to perform a treating operation in first bore 24 and/or second bore 28 without being withdrawn to surface system 4 for reconfiguration. More specifically, one trip treating tool 44 may be run downhole in a first configuration, such as shown in FIGS. 1 and 2 and positioned in second bore 28. In the first configuration, one trip treating tool 44 cannot pass through opening 36. In a second configuration, such a shown in FIG. 3, one trip treating tool 44 may pass through opening 36 and into passage 37 to perform a treating operation in first bore 24.

In accordance with an aspect of an exemplary embodiment, one trip treating tool 44 includes a tubular 47 forming a seal assembly 48. One trip treating tool 44 also includes a shroud or sleeve 50 that may selectively extend about seal assembly 48. Seal assembly 48 includes an outer surface 60 and an inner surface 62 that defines a passage 64. (FIG. 2) Outer surface 60 includes a diameter that is less than the second diameter of opening 36. Seal assembly 48 also includes a terminal end portion 66. A plurality of seal members including a first seal member 70 and a second seal member 71 may be arranged on outer surface 60 adjacent to terminal end portion 66. A third seal member 73 may be arranged on outer surface 60 at a position uphole of first and second seal members 70 and 71. It is to be understood that the number and location of seal members may vary.

In further accordance with an exemplary aspect, seal assembly 48 includes a pathway 79 that extends between outer surface 60 and inner surface 62. A shifting sleeve 82 may be arranged on inner surface 62 to selectively cover pathway 79. Shifting sleeve 82 includes an uphole end 83 that defines a ball seat 84. A drop ball, such as shown at 86 in FIG. 3, may be employed to selectively shift shifting sleeve 82 to uncover pathway 79. More specifically, drop ball 86 may be dropped downhole and seat against ball seat 84. A pressure may be introduced into system of tubulars 20 causing shifting sleeve 82 to move downhole uncovering pathway 79. In this manner, fluid within passage 64 may flow radially outwardly of seal assembly 48 as will be detailed below.

In still further accordance with an exemplary aspect, shroud 50 is positioned about outer surface 60 over pathway 79. Shroud 50 includes a body 90 having an uphole end portion 92, a downhole end portion 94, and an intermediate portion 96. Shroud 50 also includes an outer surface portion 104, an inner surface portion 106, and radially inwardly directed projection 110 provided with a seal element 112. Outer surface portion 104 includes a diameter (not separately labeled) that is less than the first diameter of second bore 28 and greater than the first diameter of opening 36. Radially inwardly directed projection 110 extends from intermediate portion 96 towards seal assembly 48. More specifically, radially inwardly directed projection 110 extends from inner surface portion 106 toward seal assembly 48 with seal element 112 engaging outer surface 60. A chamber 120 is formed between inner surface portion 106, outer surface 60, uphole end portion 92, and radially inwardly directed projection 110. Chamber 120 is selectively fluidically connected to passage 64 through pathway 79.

Figure 4:
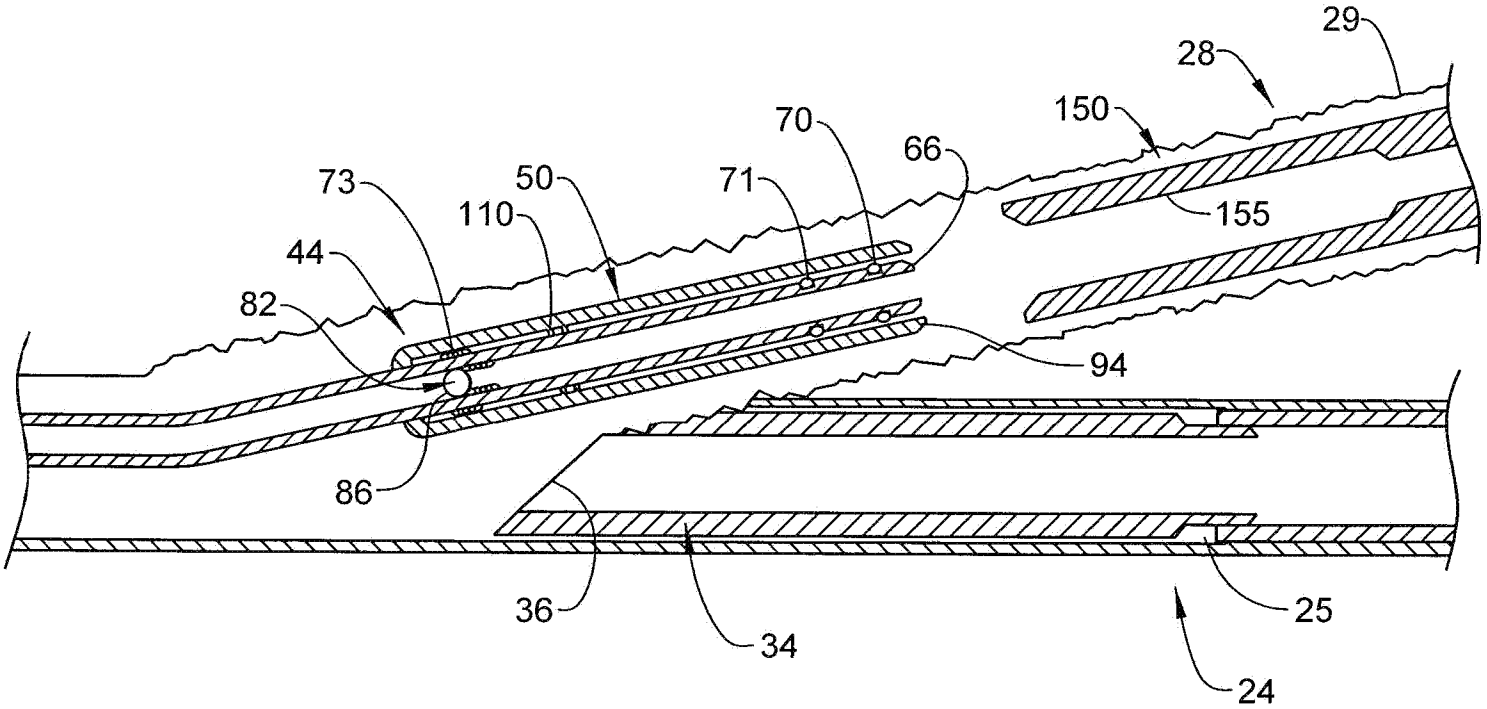
FIG. 4 depicts the one trip treating tool deployed in a first bore of a wellbore, in accordance with an aspect of an exemplary embodiment.

In accordance with an aspect of an exemplary embodiment illustrated in FIG. 4, one trip treating tool 44 is guided downhole through wellbore 21 in a run in configuration with downhole end portion 94 of shroud 50 extending to abut terminal end portion 66 of seal assembly 48. Downhole end portion 94 may stop slightly uphole of terminal end portion 66 or may extend beyond terminal end portion 66. Upon reaching diverter 34, one trip treating tool 44 transitions into second bore 28. That is, as outer surface portion 104 of shroud 50 includes a diameter that is greater than the diameter of opening 36, one trip treating tool 44 passes along diverter 34 into second bore 28.

Figure 5:
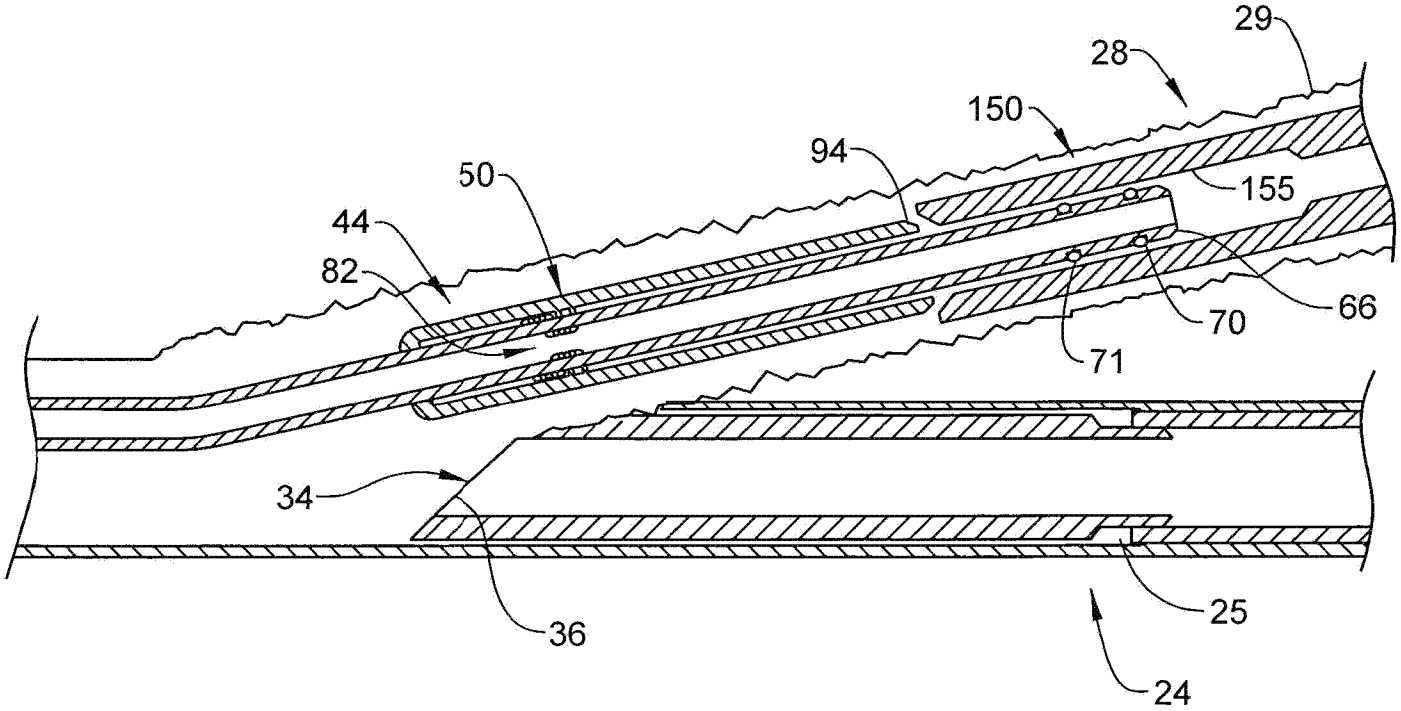
FIG. 5 depicts the one trip treating tool coupled to a liner in the first bore of FIG. 4, in accordance with an aspect of an exemplary embodiment.
Figure 6:
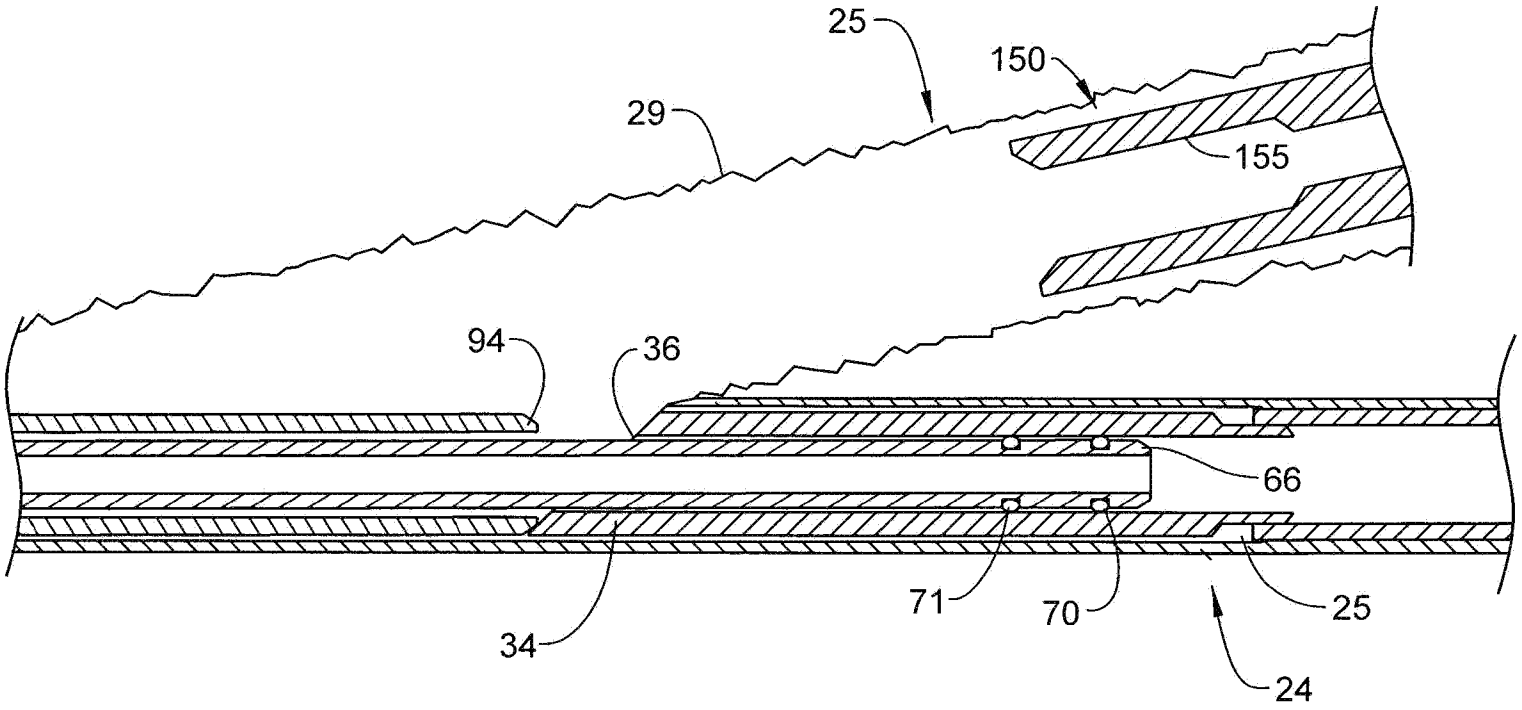
FIG. 6 depicts the one trip treating tool deployed in a second bore of a wellbore, in accordance with an aspect of an exemplary embodiment.

Once in second bore 28, drop ball 86 may be introduced into system of tubulars 20. A pressure may be introduced into system of tubulars 20 causing drop ball 86 to abut ball seat 84 and shift shifting sleeve 82. Fluid may then pass through pathway 79 into chamber 120. As pressure builds in chamber 120 against seal member 73 and radially inwardly directing projection 110, shroud 50 may transition in an uphole direction exposing terminal end portion 66 of seal assembly 48 as shown in FIG. 5. One trip treating tool 44 may then be guided further downhole into second bore 28 causing seal assembly 48 to extend into a liner 150. Seal members 70 and 71 may seal against an inner surface 155 of liner 150 and a treatment operation may commence in second bore 28.

Once treatment is complete in first bore 24, one trip treating tool 44 may be withdrawn uphole to a position uphole of diverter 34. At this point, one trip treating tool 44 may again be moved downhole with seal assembly 48 passing through opening 36 into passage 37. Seal members 70 and 71 may seal against an inner surface (not separately labeled) of passage 37 and a treating operation may commence in first bore 24. Thus, the exemplary embodiment describes a treating tool that may be deployed into a bore hole for a first treating operation, and then shifted into a second bore hole for a second treating operation without the need to be withdrawn to the surface for reconfiguration.

Embodiment 1: A method of treating a first bore and at least one second bore connected to the first bore in one downhole trip of a treating tool comprising: guiding a treating tool including a seal assembly defining a first diameter and a shroud extending about the seal assembly defining a second diameter downhole; guiding the seal assembly and the shroud along a diverter positioned near an intersection of the first bore and the at least one second bore into the at least one second bore having a third diameter greater than the second diameter; shifting the shroud relative to the seal assembly exposing the seal assembly in the at least one second bore; performing a first treatment in the at least one second bore; positioning the seal assembly and the shroud uphole of the diverter; passing the seal assembly through an opening in the diverter having a diverter opening including a fourth diameter greater than the first diameter and smaller than the second diameter; and performing a second treatment in the first bore.

Embodiment 2: The method of embodiment 1, further comprising: positioning the seal assembly and the shroud uphole of a second bore liner arranged in the at least one second bore.

Embodiment 3: The method of embodiment 2, further comprising: extending the seal assembly into the second bore liner after shifting the shroud.

Embodiment 4: The method of embodiment 1, wherein extending the seal assembly into the second bore liner includes engaging one or more seals provided on an outer surface of the seal assembly with an inner surface of the second bore liner.

Embodiment 5: The method of embodiment 1, wherein shifting the shroud includes moving the shroud in an uphole direction.

Embodiment 6: The method of embodiment 5, wherein shifting the shroud includes introducing a fluid into a chamber arranged between the shroud and the seal assembly.

Embodiment 7: The method of embodiment 6, wherein introducing the fluid into the chamber includes passing the fluid through a passage formed in the seal assembly.

Embodiment 8: The method of embodiment 7, wherein passing the fluid through the passage includes shifting a sleeve arranged within the seal assembly to uncover the passage.

Embodiment 9: The method of embodiment 8, wherein shifting the sleeve includes dropping a ball onto the sleeve and applying fluid pressure to the ball.

Embodiment 10: The method of embodiment 9, further comprising: removing the ball from the sleeve.

Embodiment 11: The method of embodiment 10, wherein removing the ball from the sleeve includes forcing the ball through an opening defined by the sleeve.

Embodiment 12: The method of embodiment 10, wherein removing the ball from the sleeve includes dissolving the ball.

Embodiment 13: The method of embodiment 10, wherein performing the treatment includes removing the ball from the sleeve.

Embodiment 14: A one trip treating tool comprising: a tubular defining a seal assembly having an inner surface defining a passage, an outer surface and a terminal end portion; and a shroud arranged about the outer surface adjacent the terminal end portion of the seal assembly, the shroud being sized to pass into a first bore of a well bore, the first bore having a first diameter, and the seal assembly being sized to pass into a second bore of the wellbore, the second bore having a second diameter that is less than the first diameter, the one trip treating tool being operable to perform a treatment of each of the first and second bores in one downhole trip.

Embodiment 15: The one trip treating tool according to embodiment 14, wherein the shroud includes an uphole end portion, a downhole end portion, and an intermediate portion, the intermediate portion including a radially inwardly directed protrusion that is substantially fluidically sealed against the outer surface.

Embodiment 16: The one trip treating tool according to embodiment 15, further comprising: a chamber arranged between the shroud and the outer surface, the chamber extending from the uphole end portion to the radially inwardly directed protrusion.

Embodiment 17: The one trip treating tool according to embodiment 16, further comprising: at least one pathway extending through the seal assembly fluidically connecting the passage and the chamber.

Embodiment 18: The one trip treating tool according to embodiment 17, further comprising: a seal member arranged in the chamber uphole of the passage, the seal member being in sealing engagement with the shroud.

Embodiment 19: The one trip treating tool according to embodiment 17, further comprising: a shifting sleeve arranged in the passage at the pathway, the shifting sleeve being selectively shiftable to expose the pathway to the passage.

Embodiment 20: The one trip treating tool according to embodiment 19, wherein the shifting sleeve includes an uphole end defining a ball seat.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The term "about" is intended to include the degree of error associated with measurement of the particular quantity based upon the equipment available at the time of filing the application. For example, "about" can include a range of ±8% or 5%, or 2% of a given value.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A method of treating a first bore and at least one second bore connected to the first bore in one downhole trip of a treating tool comprising:

guiding the treating tool including a seal assembly defining a first diameter and a shroud extending about the seal assembly defining a second diameter downhole;

guiding the seal assembly and the shroud along a diverter positioned near an intersection of the first bore and the at least one second bore into the at least one second bore having a third diameter greater than the second diameter;

shifting the shroud relative to the seal assembly in an uphole direction by introducing a fluid into a chamber arranged between the shroud and the seal assembly thereby exposing the seal assembly in the at least one second bore;

performing a first treatment in the at least one second bore;

positioning the seal assembly and the shroud uphole of the diverter;

passing the seal assembly through an opening in the diverter having a diverter opening including a fourth diameter greater than the first diameter and smaller than the second diameter; and performing a second treatment in the first bore.

2. The method of claim 1, further comprising: positioning the seal assembly and the shroud uphole of a second bore liner arranged in the at least one second bore.

3. The method of claim 2, further comprising: extending the seal assembly into the second bore liner after shifting the shroud.

4. The method of claim 3, wherein extending the seal assembly into the second bore liner includes engaging one or more seals provided on an outer surface of the seal assembly with an inner surface of the second bore liner.

5. The method of claim 1, wherein introducing the fluid into the chamber includes passing the fluid through a passage formed in the seal assembly.

6. The method of claim 5, wherein passing the fluid through the passage includes shifting a sleeve arranged within the seal assembly to uncover the passage.

7. The method of claim 6, wherein shifting the sleeve includes dropping a ball onto the sleeve and applying fluid pressure to the ball.

8. The method of claim 7, further comprising: removing the ball from the sleeve.

9. The method of claim 8, wherein removing the ball from the sleeve includes forcing the ball through an opening defined by the sleeve.

10. The method of claim 8, wherein removing the ball from the sleeve includes dissolving the ball.

11. The method of claim 8, wherein performing the treatment includes removing the ball from the sleeve.

12. A one trip treating tool comprising:

a tubular defining a seal assembly having an inner surface defining a passage, an outer surface and a terminal end portion; and a shroud arranged about the outer surface adjacent the terminal end portion of the seal assembly, the shroud being sized to pass into a first bore of a well bore, the first bore having a first diameter, and the seal assembly being sized to pass into a second bore of the wellbore, the second bore having a second diameter that is less than the first diameter, the one trip treating tool being operable to perform a treatment of each of the first and second bores in one downhole trip, the shroud being shiftable in an uphole direction by introducing a fluid into a chamber arranged between the shroud and the seal assembly.

13. The one trip treating tool according to claim 12, wherein the shroud includes an uphole end portion, a downhole end portion, and an intermediate portion, the intermediate portion including a radially inwardly directed protrusion that is substantially fluidically sealed against the outer surface.

14. The one trip treating tool according to claim 13, further comprising: a chamber arranged between the shroud and the outer surface, the chamber extending from the uphole end portion to the radially inwardly directed protrusion.

15. The one trip treating tool according to claim 14, further comprising: at least one pathway extending through the seal assembly fluidically connecting the passage and the chamber.

16. The one trip treating tool according to claim 15, further comprising: a seal member arranged in the chamber uphole of the pathway, the seal member being in sealing engagement with the shroud.

17. The one trip treating tool according to claim 15, further comprising: a shifting sleeve arranged in the passage at the pathway, the shifting sleeve being selectively shiftable to expose the pathway to the passage.

18. The one trip treating tool according to claim 17, wherein the shifting sleeve includes an uphole end defining a ball seat.

* * * * *